United States Patent [19]

Cline et al.

[11] Patent Number: 4,687,410

[45] Date of Patent: Aug. 18, 1987

[54] TORQUE LIMITER FOR PRIME MOVER

[75] Inventors: John A. Cline, Earlysville, Va.; William N. Iuliano, Sterling Junction, Mass.

[73] Assignee: General Electric Company, Schenectady, N.Y.

[21] Appl. No.: 766,465

[22] Filed: Aug. 19, 1985

[51] Int. Cl.[4] ..... F01D 17/06

[52] U.S. Cl. ..... 415/17; 415/30

[58] Field of Search ..... 415/17, 30, 36, 40, 415/42, 43; 364/494

[56] References Cited

U.S. PATENT DOCUMENTS

| | | | |
|---|---|---|---|
| 3,064,435 | 11/1962 | Wagner et al. | 415/17 |
| 3,233,412 | 2/1966 | Wagner | 415/17 X |
| 3,342,195 | 9/1967 | Wagner | 415/17 X |
| 3,655,293 | 4/1972 | Williams | 415/17 |
| 3,934,128 | 1/1976 | Uram | 415/17 X |
| 4,005,581 | 2/1977 | Aanstad | 415/17 X |
| 4,494,207 | 1/1985 | Chang et al. | 364/494 |

OTHER PUBLICATIONS

Power Magazine, Skrotzki, Steam Turbines–1962.

*Primary Examiner*—Everette A. Powell, Jr.
*Attorney, Agent, or Firm*—Jerome C. Squillaro

[57] ABSTRACT

A control system for a steam turbine which system includes apparatus for adjusting steam flow to regulate turbine shaft speed and a transducer for providing signals indicative of turbine shaft speed, is provided with a feedback control system which modifies the shaft speed as a function of torque of the turbine. The feedback control system regulates a speed command signal which modifies the operation of the steam flow adjusting apparatus to thereby limit torque. The torque signal is developed by measurement of first stage shell pressure in the steam turbine and conversion of a signal representative of pressure to a signal representative of torque. In one embodiment, the conversion process involves utilization of plural look-up tables in a microprocessor implemented control system. The look-up table data is provided from characteristic curves of the steam turbine.

7 Claims, 5 Drawing Figures

TORQUE LIMITER FOR PRIME MOVER

BACKGROUND OF THE INVENTION

The present invention is related to control systems for steam turbines and, more particularly, to control systems for controlling torque of variable speed steam turbines.

Steam turbines are principally used as prime movers although there are some instances in which such turbines are applied as loads for other prime movers or occasionally as steam pressure reducers. When used as either a prime mover or a load, a shaft of the turbine is coupled through a clutch or other type connector to a rotating shaft of a driving or driven apparatus. If the torque reflected from the apparatus to the turbine exceeds the torque handling capacity of the connector, the connector may be damaged or destroyed. Alternately, the shaft of the turbine or the apparatus may be overstressed leading to deformation or breakage.

Prior art control systems for turbines have basically concentrated on a speed control, i.e., maintaining a constant shaft speed without regard for torque. Provided that the turbine and attendant connections are over-designed, such speed controls are satisfactory. However, over-designing the turbine and connections is not economical and cannot assure that a torque will not be experienced which exceeds even the over-designed characteristics. Furthermore, such speed controls tend to aggravate overload situations by attempting to generate additional torque in order to maintain a constant speed.

OBJECTS AND SUMMARY OF THE INVENTION

It is an object of the present invention to provide a control system for a steam turbine which limits shaft torque.

It is another object of the present invention to provide a control system for a steam turbine which incorporates a torque limit as a function of shaft speed to thereby limit torque over the turbine speed range.

It is still another object of the present invention to provide a turbine torque control system which limits torque as a function of steam pressure in the turbine.

In one aspect of the present invention, a torque limit function is incorporated in a control system for a steam turbine in which the control system is an electronic governor. The control system includes apparatus for adjusting steam flow to regulate turbine shaft speed as a function of the difference between shaft speed and a speed reference command by generating a difference error signal. Torque control is implemented by developing a signal representative of shaft torque, preferrably using steam pressure in a first stage of the turbine and applying the torque signal to limit the magnitude of the speed command signal in accordance with a predetermined relationship between shaft speed and torque.

In a preferred embodiment, a microprocessor based control system is employed in which analog signals from sensors associated with the turbine are converted to digital signals. The first stage steam pressure, in digital form, is converted to a signal representative of steam flow using a look-up table in a digital memory in which there is stored values representative of steam flow as a function of steam pressure of the turbine. The steam flow values are converted to torque values using a second look-up table in which the latter values are stored.

The torque values are applied both to change the speed command signal and to a servo-amp controlling the steam flow apparatus. The signal applied to the servo-amp acts to more rapidly change steam flow.

BRIEF DESCRIPTION OF THE DRAWINGS

The above and other objects, features and advantages will become apparent from the following description taken in conjunction with the accompanying drawing in which.

DETAILED DESCRIPTION

Figure 1:
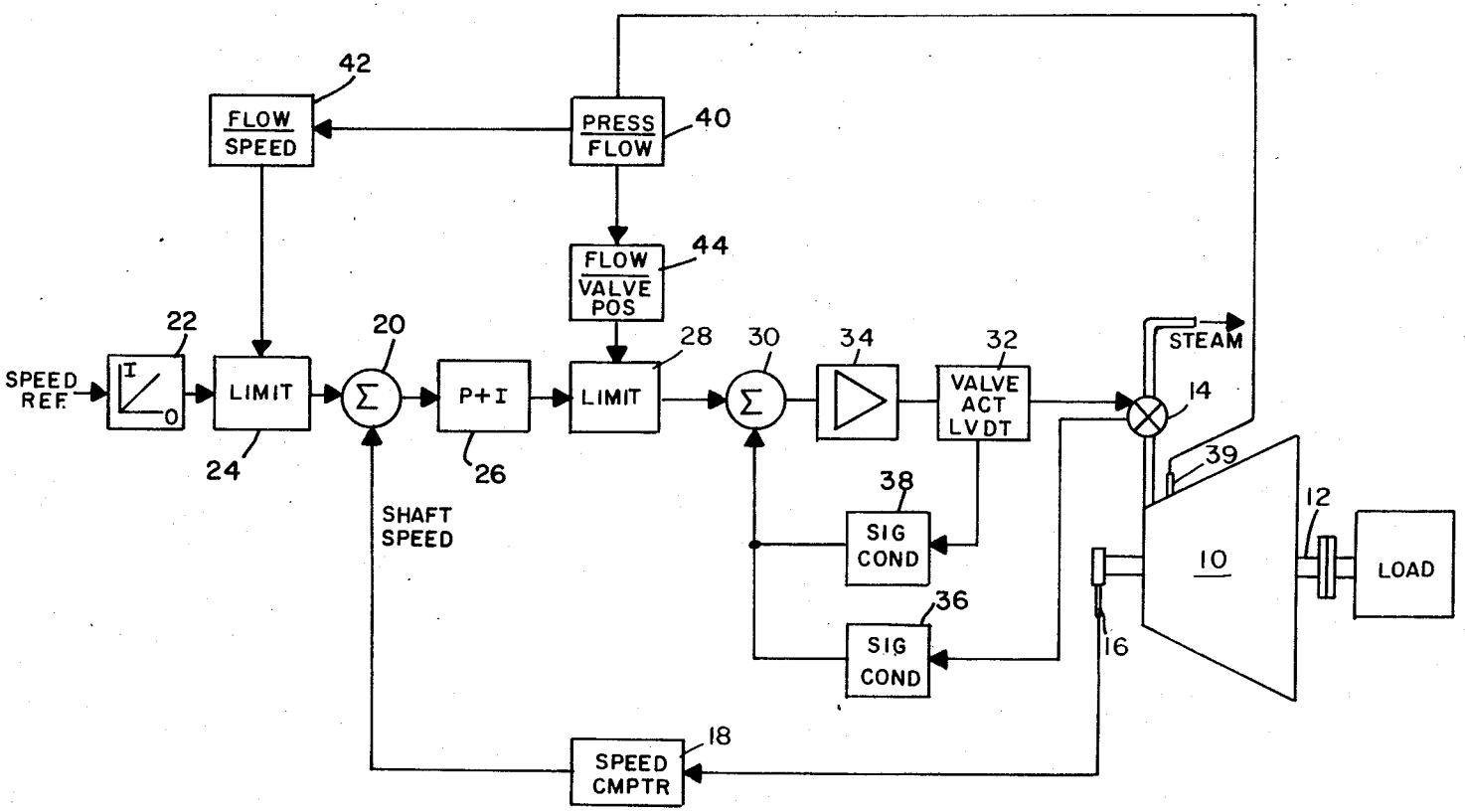
FIG. 1 is a functional block diagram of a control system in accordance with the present invention.

Referring now to FIG. 1, there is shown a functional block diagram of a control system for controlling the speed of a variable speed steam turbine 10 which system incorporates torque limiting. Turbine 10 may be a conventional, industrial or marine steam turbine suitable for applying torque to a drive shaft 12 at a controllable speed and torque. Steam turbine 10 is driven by steam generated in a conventional steam source (not shown) and fed through a valve 14 to turbine 10. The details of turbine 10 and valve 14 are well known in the art and are not described herein. A thorough review of steam turbines and various valve arrangements is given in the June, 1962 issue of POWER magazine, published by McGraw-Hill, Inc. in a 40-page article entitled "Steam Turbines".

The basic mode of control of a steam turbine is speed control and to this end the control system of FIG. 1 includes a speed sensing device 16 shown adjacent the turbine shaft 12 for generating signals representative of shaft speed. Since the illustrative embodiment is a digital system, preferrably a microprocessor system, the speed signals are digital signals and may advantageously be obtained using a toothed wheel on shaft 12 and an appropriate magnetic, capacitive, inductive or optical sensor 16. A more detailed description of a speed responsive turbine control is given in U.S. Pat. No. 4,494,207 issued Jan. 15, 1985 and assigned to General Electric Company. As disclosed therein, the speed signals may comprise multiple signals from multiple sensors which are applied to primary and secondary control circuits, both including computer processors, for providing redundant control of the turbine. For purposes of describing the present invention, reference will be made only to a primary control system with the understanding that an identical redundant system may be used for back-up of the primary system. Accordingly, the disclosure of the U.S. Pat. No. 4,494,207 is hereby incorporated by reference.

The speed signal from sensor 16 is processed by a speed computer 18 which eliminates any faulty signals and calculates and applies a digital speed feedback signal to a summing junction 20. The operation and a more descriptive discussion of speed computer 18 is given in the aforementioned U.S. Pat. No. 4,494,207.

A speed referecne signal SPEED REF is provided from an external source, such as an operator's console, as a desired operating speed for the turbine 10. Since SPEED REF is typically a step function, a ramp function generator 22 is utilized to gradually permit the speed reference signal to increase from zero to the desired value at a predetermined rate. Apparatus for performing such integrating functions in both analog and digital systems are well known in the art and do not form a part of the present invention.

The integrated speed reference signal is first processed through a limit control function illustrated as a limiter 24. Functionally, the limiter 24 allows the speed reference signal to pass through unchanged so long as the value of the signal is less than a value determined dynamically by a torque reference signal also coupled to limiter 24. Design and arrangement of such limiting functions are well known to those skilled in the electronics and computer arts. In analog form the limiter 24 may be a clamp circuit in which the clamp voltage is set by the torque reference signal. In the computer form the limiter 24 may be implemented by a digital comparator. The particular implementation is not considered unique to the present invention.

Before addressing the novel torque control features of the present invention, the processing of the speed command control signals of FIG. 1 will continue to be described. The speed reference signal from limiter 24 is coupled functionally to the summing junction 20 where the difference between the speed feedback signal from speed computer 18 and the speed reference signal is used to generate a speed error signal. The speed error signal is then coupled to a proportional plus integral circuit 26 of a type well known in the control art. The circuit 26 compensates for the fact that the speed error signal goes to zero as the turbine shaft speed reaches its desired value. The error signal, after processing by circuit 26, thus becomes a scaled speed command signal representative of steam valve lift or desired steam flow, i.e., a steam flow signal.

From circuit 26 the steam flow signal is coupled through a second limiter function block 28. The limiting function in block 28 is substantially identical to that performed by limiter 24 and is inserted here in order to provide a faster system response time and to prevent overload of circuit 26. As will become apparent, a sudden torque applied to turbine 10 will create a transient pulse from limiter 24 which may result in saturation of circuit 26. By effecting a torque limit adjustment at block 28, the response of the system becomes faster and any overload signal from circuit 26 is limited.

The torque limited signal from block 28 is next coupled to a summing function 30. As was previously stated, the speed signal is scaled by circuit 26 so that the value of the scaled signal is representative of the desired position of steam valve 14.

Associated with the valve 14 is a linear variable displacement transformer (LVDT) which provides an output signal representative of valve position. Also connected to valve 14 is an electro-hydraulic valve actuator 32. The actuator 32 also includes a LVDT for providing a signal representative of actuator position. Neither LVDT is shown in the drawing but such devices and their application are well known in the art. A servo-amplifier 34 provides a drive signal which operates the actuator 32 which in turn controls the position of the steam valve 14. Both the actuator 32 and valve 14 include closed loop feedback for stabilization. The LVDT signal from valve 14 is conditioned by a circuit 36 before being summed with the valve position command signal in junction 30. The LVDT signal from actuator 32 is similarly conditioned in a circuit 38 before being summed in junction 30. the electro-hydraulic actuator and steam control valve are discussed more thoroughly in the aforementioned "Steam Turbine" article from *POWER* magazine.

The basic speed control system thus far described is essentially the same as that disclosed in greater detail in the aforementioned U.S. Pat. No. 4,494,207. The differences lie primarily in the addition of the two limiter functions 24 and 28 which allow the speed steam flow control signals to be modified as a function of torque. It will be apparent that the functional block diagram of FIG. 1 is not intended to necessarily represent a sequence of individual circuit elements although the system could be constructed using equivalent analog or digital circuits for each of the functional blocks. In a preferred embodiment, the functions, with the exception of the electromechanical drives, are implemented in a microcomputer utilizing an Intel Corp. 88/40 computer board and various dedicated digital logic arrangements of the type disclosed in U.S. Pat. No. 4,494,207.

The improvements to the control system of FIG. 1 include a pressure transducer 39 connected to a first stage pressure chamber of turbine 10 for sensing the steam pressure therein, generally referred to as first stage shell pressure. A typical transducer is available from Rosemont, Inc. and provides a sensed signal varying between 4 to 20 MA for pressure from 200 to 1,000 PSI. For any given steam turbine, this steam pressure can be translated to a signal proportional to steam flow and eventually to shaft torque. For example, referring to FIG. 2, there is shown a graph of first stage shell pressure as a function of steam flow in pounds per second at a desired steam exhaust pressure. Such graphs may be determined by operating the turbine while measuring the values of interest using the transducer 39 with its output signal calibrated to be proportional to steam pressure over the range of interest. In FIG. 3 there is shown a second graph which illustrates horsepower as a function of steam flow at constant speed.

Figure 4:
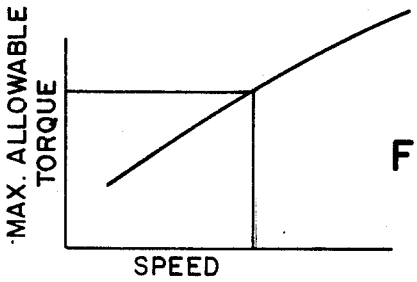
FIG. 4 is a graph of maximum allowable torque as a function of shaft speed.
Figure 5:
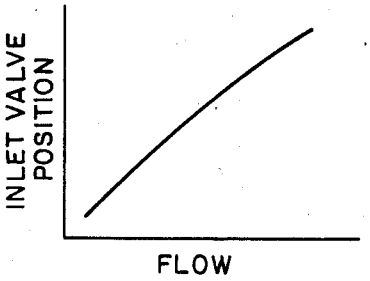
FIG. 5 is a graph of steam inlet valve position as a function of steam flow.

FIG. 4 is a graph illustrating maximum allowable torque as a function of shaft speed. This graph is typical of turbine characteristic performance curves determined for each turbine. Knowing actual torque from the procedure above and also knowing speed, FIG. 4 can be used to determine if the actual torque is exceeding the max allowable torque. If the actual torque tends to exceed the allowable torque, the steam flow must be reduced such that the resulting horsepower yields a safe level of torque. Since flow is controlled via inlet valve position the governor must re-position the inlet valves to pass the required reduced flow. FIG. 5 is a typical curve of inlet valve position vs. flow. Knowing the actual valve position (for a desired flow) from FIG. 5, a max valve opening limit can be set by the governor.

It will be appreciated that each of the relationships illustrated in FIGS. 2–5 are readily convertible to digital data which can be stored in look-up tables as disclosed in the preferred embodiment of the present invention.

Figure 2:
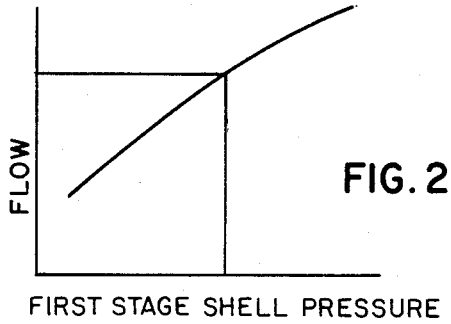
FIG. 2 is a plot of first stage steam pressure versus steam flow in an exemplary turbine.
Figure 3:
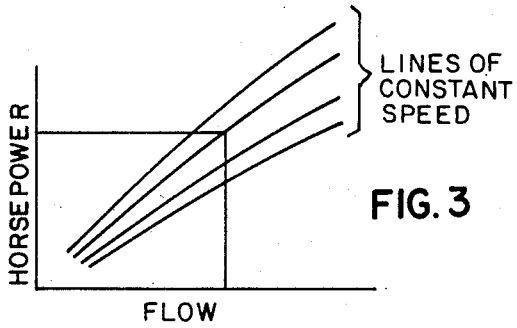
FIG. 3 is a graph of steam flow versus horsepower in the turbine of FIG. 2.

Referring again to FIG. 1, the signal from the pressure transducer in the first stage of turbine 10 is coupled to a first conversion unit 40 which converts the signal to a signal representative of steam flow using the translation relationship shown in FIG. 2. In the preferred embodiment, the conversion unit 40 includes an analog to digital (A/D) convertor since the signal from the pressure transducer is in analog form. The translation functions may be stored in a digital memory unit, e.g., a ROM or read only memory, in the form of a look-up table. The digital signal from the A/D convertor can be used as an address to directly locate the corresponding steam slow data or the digital signal may be used as a pointer to indirectly locate the corresponding steam flow values. Either method is acceptable and well known in the digital control art.

In order to limit torque as the turbine 10 is accelerated, e.g., at start-up, the steam flow value from unit 40 is coupled to a second conversion unit 42 which translates steam flow into values representative of per unit speed in accordance with the function shown in FIG. 5. The unit 42 may similarly comprise a look-up table in a digital memory device and the steam flow value may be used either as an address or a pointer. The translation in accordance with FIG. 5 results in a limit function which is coupled to the limiter 24 and operates to prevent the speed command or speed reference signal from exceeding the value established by the graph of FIG. 5. For example, at a steam flow of 75 pounds per second, and 585 PSI exhaust pressure, the maximum speed reference signal value is limited to 0.75 per unit, i.e., at a rated speed of 5100 RPM, maximum speed is 3825 RPM. However, at lower steam flow and lower exhaust pressure as shown by the curve marked 383 PSI, the per unit speed values are higher. As is known, there is a family of curves which can be plotted as a function of steam flow and speed by varying the exhaust pressure demands. By limiting the value of the speed reference signal as a function of steam flow, it will be seen that the torque at the turbine can be limited as a function of speed since steam flow is directly related to torque. The relationships between steam flow and torque can be more clearly seen by reference to FIG. 3. Each of the graph functions illustrates a different speed line. The graphs at A and B show the constant exhaust steam pressure plots for 585 PSI and 383 PSI, respectively. It will be apparent that sudden torque changes at turbine 10, such as might occur if a load were suddenly applied or removed, will result in an impulse function being applied at limiter 24. Any large impulse function will tend to saturate the proportional plus integral circuit 26 and cause perturbations in the system. Accordingly, the steam flow value from conversion unit 40 is applied to a further conversion unit 44 which latter unit may be substantially identical to unit 42. The conversion unit 44 translates the steam flow value to a control valve lift limit value in accordance with the graph of FIG. 3. The valve lift value is then applied directly as a limit to the value of the signal developed by circuit 26. Thus, torque surge protection is provided as a bypass of the proportional plus integral circuit 26. Not only does this feature overcome the potential saturation difficulty with circuit 26, it also provides a faster response time for the torque limit function by applying a restriction more directly to the servo-amp 34. Since steam flow has been shown to be indicative of turbine torque for any given exhaust pressure, it can be seen that the effect of the limiter 28 is to apply a limit to turbine torque.

Although the invention has been disclosed in what is presently considered to be a preferred embodiment, it will be appreciated that many modifications, variations and changes may be made without departing from the teachings of the invention. Accordingly, it is intended that the description be interpreted as illustrative and not in a limiting sense and that the invention be given its full scope and spirit as defined by the appended claims.

We claim:

1. An improved turbine control system for a steam turbine of the type having a control valve for regulating the flow of steam into the steam turbine, the control system including a speed reference input signal and a speed feedback signal indicative of turbine shaft speed; the control system further including a first summing junction for combining the speed reference signal and the speed feedback signal to provide a valve position command signal; a second summing junction for combining the valve position command signal with at least one valve actual position signal to provide a valve position error signal, wherein the improvement to the control system comprises:

means for sensing steam pressure in said steam turbine and providing a pressure signal;

means for converting the pressure signal into a steam flow signal;

a first signal limiter connected upstream from the first summing junction for receiving a maximum allowable speed signal in accordance with the steam flow signal; and, a second signal limiter connected downstream from the first summing junction but upstream from the second summing junction for receiving a maximum allowable valve position signal in accordance with the steam flow signal; and, wherein flow converted to speed and flow converted to valve position are maximum allowable torque signals.

2. The improvement recited in claim 1 further comprising:

means connected to the first signal limiter for converting the steam flow signal into a speed/torque signal; and, means connected to the second signal limiter for converting the steam flow signal into a valve position signal.

3. The improvement recited in claim 1 wherein the first signal limiter is upstream from a proportional plus integral device and the second signal limiter is downstream from the proportional plus integral device.

4. The improvement of claim 1 wherein said means for converting said steam pressure signal to said steam flow signal comprises a first digital memory means having stored therein a plurality of digital steam flow values, each of said steam flow values corresponding to a steam pressure value for the turbine, said digital signal representing a steam pressure value for accessing a corresponding one of said steam flow values.

5. The improvement claim 4 wherein means for deriving said torque signal comprise a second digital memory means having stored therein a plurality of torque valves each corresponding to a steam flow value, said digital steam flow values from said first memory means representing a digital signal for accessing a corresponding one of said torque values.

6. A control system for a steam turbine of the type including at least a first stage to which steam is applied to effect rotation of a shaft of the turbine, the control system comprising:

a main steam valve for controlling the flow of steam to the turbine;

a mechanical drive mechanism connected to the main steam valve for operating said steam valve;

a servoamplifier connected to the mechanical drive mechanism responsive to a valve error signal for actuating said drive mechanism;

a valve position sensor for providing a signal representative of the displacement of said steam valve relative to a closed position;

means for summing a valve position command signal with said displacement signal for generating said valve error signal;

a valve lift command limit circuit having a first input terminal for receiving a main steam valve lift command and an output terminal for providing a (magnitude amplitude) limited valve position command signal;

means for obtaining a signal representative of torque developed by the turbine;

means coupling said torque signal to said limit circuit for modifying said valve lift command as a function of the torque developed by said turbine shaft;

means for obtaining a signal representative of the shaft speed of the turbine;

means for summing said shaft speed signal with a speed reference signal to develop said valve lift command;

a speed reference limit circuit having a first terminal connected to receive a turbine speed command signal and a second terminal connected to receive said torque signal whereby said torque signal is effective to limit the magnitude of said speed command to thereby generate said torque limited speed reference signal.

7. In a steam turbine control system of the type including a steam valve for regulating steam flow to the turbine; an apparatus for adjusting the steam valve position in response to a turbine speed command signal, an improvement comprising means for limiting the value of the speed command signal as a function of torque including:

means for sensing steam pressure at a first stage of the turbine;

means receiving the sensed steam pressure for converting the sensed steam pressure to corresponding values of steam flow;

means connected to the speed command signal for limiting the speed command signal to values not exceeding the turbine torque limit value;

means for converting the steam flow values to corresponding steam valve lift limit values; and, means for applying the lift limit values to the speed command signal for limiting the steam valve position.

* * * * *